United States Patent [19]

Beach

[11] Patent Number: 4,457,502

[45] Date of Patent: Jul. 3, 1984

[54] SIMPLE DENTAL SERVICE EQUIPMENT

[75] Inventor: Raymond D. Beach, Shizuoka, Japan

[73] Assignee: Kabushiki Kaisha Morita Seisakusho, Japan

[21] Appl. No.: 526,223

[22] Filed: Aug. 25, 1983

Related U.S. Application Data

[63] Continuation of Ser. No. 265,171, May 19, 1981, abandoned.

[30] Foreign Application Priority Data

May 28, 1980 [JP] Japan ..... 55/74378[U]

[51] Int. Cl.[3] ..... A61G 13/00

[52] U.S. Cl. ..... 269/11; 269/16; 269/322

[58] Field of Search ..... 269/322, 328, 11, 16, 269/901; 108/23, 50, 127, 121; 128/70, 23; 248/246, 226.4; 211/88

[56] References Cited

U.S. PATENT DOCUMENTS

| | | | |
|---|---|---|---|
| 926,426 | 6/1909 | Koch et al. | 108/23 |
| 1,487,144 | 3/1924 | Callaway | 108/121 |
| 1,516,795 | 11/1924 | Schwarting | 269/328 |
| 3,218,058 | 11/1965 | Smith | 269/166 |
| 3,587,592 | 6/1971 | Price | 269/328 |
| 3,662,982 | 5/1972 | Antonius | 211/88 |
| 4,231,557 | 11/1980 | Blachly et al. | 269/901 |
| 4,333,638 | 6/1982 | Gillotti | 269/322 |

*Primary Examiner*—Robert C. Watson

*Attorney, Agent, or Firm*—Bacon & Thomas

[57] ABSTRACT

A structurally simplified dental service equipment generally usable for collective dental examination and practical exercises in dental hygienist training schools, wherein the equipment is easily transportable to any places in a disassembled form and assembled on the scene of dental examination, being advantageously employable as advantageously just as existing dental service equipment in use at most dental clinics.

2 Claims, 7 Drawing Figures

SIMPLE DENTAL SERVICE EQUIPMENT

This application is a continuation of application Ser. No. 265,171, filed May 19, 1981, now abandoned.

BACKGROUND OF THE INVENTION

Heretofore there have been very few particular type dental service equipment that can practically be used for the purpose of dental group examination, for instance in schools and offices. Thus the realities are that dentists with a reflex mirror on their forehead have to sit their patient on a conventional type dental chair and look from one side into the cavity of his mouth under the insufficiently reflected light of the mirror at their slightly slouched posture. This has the results in dentists not being able to always find out the affected parts of a patient's teeth and/or teethbridge nor check any delicately affected parts to the fullest extent. Besides, they get easily fatigued due to their slouched posture that must be kept for a long length of time running so that as they examine the mouth cavity of a patient after another, who are waiting at the tail of a queue, they are increasigly liable to overlook the patients' affected parts or provide an erroneous diagnosis.

Statement of Objects

Accordingly, the present invention has been contrived to eliminate the above-mentioned drawbacks and disadvantages of the conventional dental service equipment, having as one of its main object the provision of a simple structure of dental service equipment having an examination bed the upper surface area of which is formed in a substantially flattened horizontal plane and widened enough to allow a patient to lie thereon, further being provided with a light projector means adapted to light on a patient's mouth cavity from a headrest of the bed so that the patient is able to be dentally treated almost in the same condition as in most dental clinics.

Another object of the invention is to provide a simple structure of dental service equipment provided in the foremost end of a bed thereof with a headrest which is detachably mounted so that when a patient lies on the bed, his mouth cavity is necessarily placed in a fixed position of the headrest irrespective of his stature, resulting in dentists being able to dentally examine the mouth cavity of the patient in a standing posture as normally practiced in their dental clinics.

Another object of the invention is to provide a dental examination bed wherein all dental instruments are mountable in a tray provided on a light projector supporting means which is within the reach of a dentist's hands.

Another object of the invention is to provide a dental examination bed that can be not only assembled easily for a short length of time as occasions need but also disassembled promptly after completion of dental examination merely by dismounting both the light projector supporting means and the headrest out of the bed body.

A further object of the invention is to provide the dental examination bed which is collapsible midway between both the forward bed portion and the rearward bed portion thereof, thus making it easy for a dentist to carry the bed per se with him, wherein the bed is provided with leg members in collapsible on detachable relation so that when not in use the bed can be made dimensionally in small size but when in use it does not need any supporting means superseding the leg members thereby enabling a dentist to practically use the bed at any location.

A still object of the invention is to provide a simple structure of dental service equipment wherein both the forward bed portion and the rearward bed portion thereof are curved into an arc shape so that patients are able to smoothly get on and off a bed of the equipment, and a dentist and his or her assistants can be prevented from being caught into protected portions of the bed when working around the equipment.

These and other objects, and novel features of the invention will more fully appear from the following detailed description when the same is read in connection with the accompanying drawings. It is also to be expressly understood, however, that the drawings are for purpose of illustration only and are not intended as a definition of the limits of the invention.

DESCRIPTION OF INVENTION IN RELATION TO DRAWINGS

Setting forth now in detail some preferred embodiments of the invention with reference to the accompanying drawings, in which numeral 1 generally designates a main dental examination bed body which is formed collapsible through means of hinges 2 substantially in the center transversing the axial direction of the bed 1. Said bed 1 is covered throughout the whole surface area thereof with a synthetic resin sheet through a cushion material 1'. A forward bed portion **1*a* of said bed 1 has a front edge 1*b* curved into such a shape as conform with the curvature of a standard size man's shoulders while a rearward bed portion 1*c* of the bed 1 has a rear edge 1*d* formed into a tapering shape with its foremost end portion being formed into an arc shape so that a patient is easily able to get on and off the bed 1**.

Figure 3:
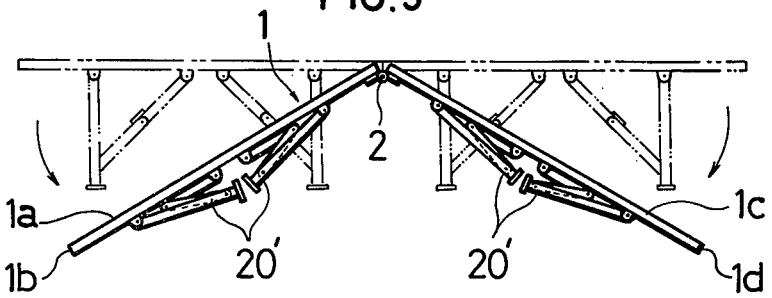
FIG. 3 is a side elevational view showing how the leg members are collapsed.

As shown in FIG. 3 of the accompanying drawings, said rearward bed portion **1*c* of the bed 1 may be gradually curved downwardly toward its foremost end whereby a patient lying on the bed 1** is able to realize steady support for his heels.

Centrally of the front edge **1*b* of said forward bed portion 1*a* there is mounted a headrest 3 which is formed integrally with a supporting frame member 4 and a frame 5 which is substantially of a U-shaped configuration in cross section and extends from one end of said supporting frame member 4. Said headrest 3 is rigidly connected to said forward bed portion 1*a* by screwably tightening said frame 5 to said portion 1***b* by means of a thumb nut 6.

Figure 4:
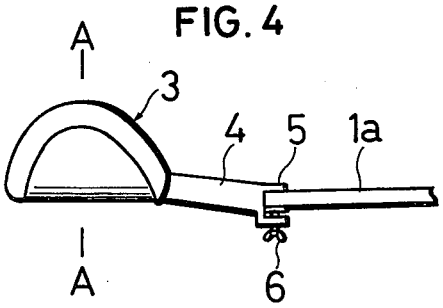
FIG. 4 is a side elevational view of a headrest employed on the dental examination bed of the invention.
Figure 5:
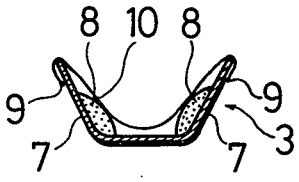
FIG. 5 is a cross sectional view taken on the line A—A of FIG. 4.
Figure 6:
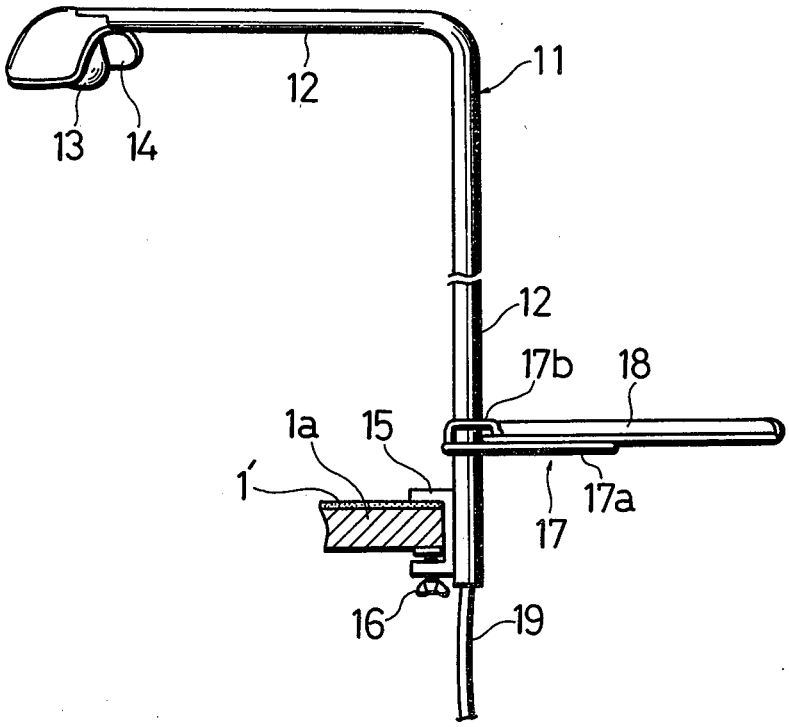
FIG. 6 is a partially cutaway side elevational view of a light projector supporting means.
Figure 7:
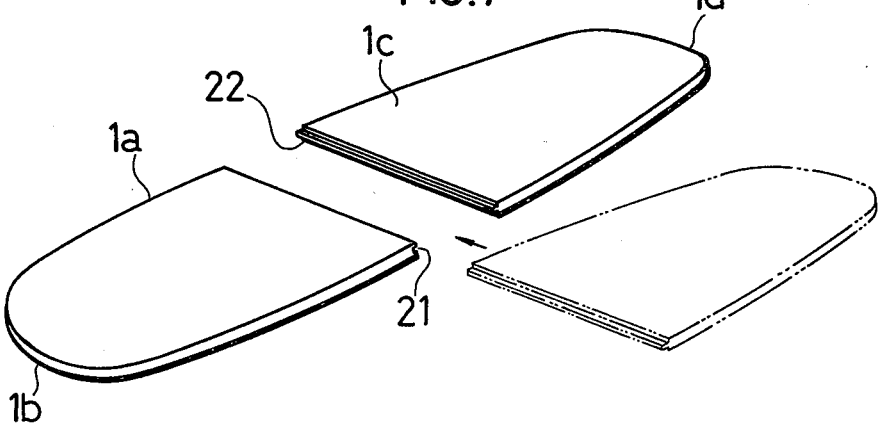
FIG. 7 is a perspective view showing how the dental examination bed is assembled into the complete form of bed.

As definitely illustrated in FIGS. 4 and 5, said headrest 3 is so constructed that both sides of a metallic plate 7 are curved in upwardly inclined relation, with their inner surfaces rigidly fixed by means of a cushion material 8. The whole surface of the metallic plate 7 is covered with a cloth on a synthetic resin sheet 10 along the outer circumference of which there is inserted a rubber string 9.

Although said headrest 3 is so simple in construction as in the foregoing description, yet a patient lying on the dental examination bed 1 of the invention can keep his head in a steady state due to the cushionability of said cushion material 8, the back of his head being free of exterior pressure due to a space formed below the back of his head thereby enabling him to keep his head in a very comfortable state.

Further said sheet 10 is washable and replaceable with a fresh sheet. Said headrest 3 is not always limited to the art disclosed in the foregoing description but may be of any other type as long as it can be removably mounted onto the edge of the examination bed 1.

Said forward bed portion 1*a* is provided at one side with a supporting means 11 for supporting a light projector 13 adapted to light on the cavity of a patient's mouth. In the uppermost end of a substantially L-shaped supporting frame 12 there are mounted said light projector 13 and a reflex mirror 14 while on the lowermost end of said frame 12 there are mounted a substantially U-shaped tightening means 15 having a thumb nut 16 and a supporting means 17 for supporting a dental tray 18. Within said supporting frame 12 is inserted an electric cord 19.

Said dental tray supporting means 17 is rigidly fixed to said supporting frame 12 over the tightening means 15 in the direction opposite thereto, comprising a ring shape supporting member 17*a* and a holding means 17*b* mounted over said member 17*a* in such a manner to leave a space therebetween so as to permit said dental tray 18 to be insertable therein. Thus the dental tray 18 inserted into a said space is held stationary by its own gravity between the ring shape supporting member 17*a* and the holding means 17*b*.

As has been clearly understood from the foregoing description, the simple dental service equipment of the invention is composed of said examination bed 1, a headrest 3 mounted detachably thereto and a light projector supporting means 11 wherein said bed 1 is adapted to be supported in a suitably selected level by means of bed supporting leg members 20.

Figure 1:
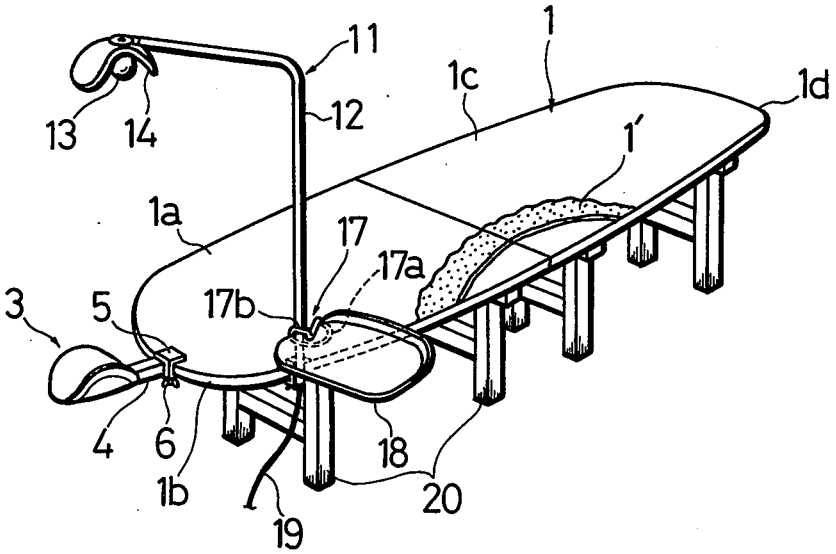
FIG. 1 is a partially cutaway perspective view of the dental examination bed embodied in accordance with the present invention.
Figure 2:
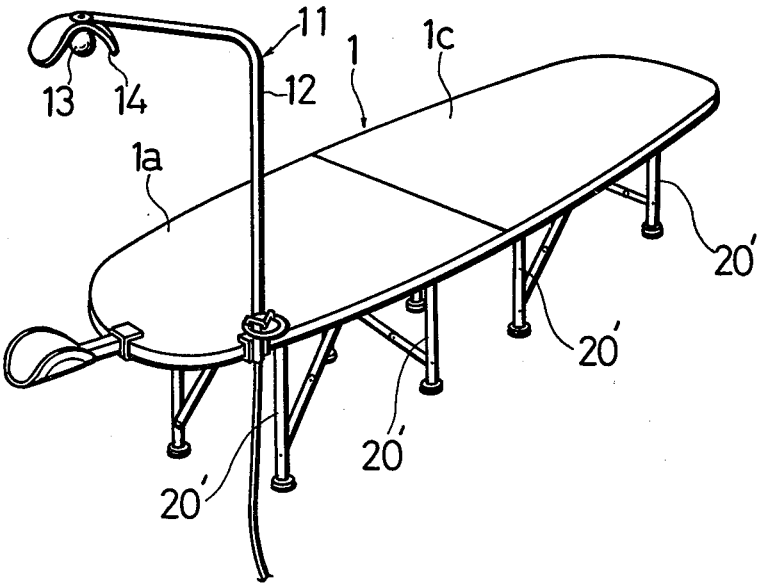
FIG. 2 is a perspective view showing the dental examination bed provided with collapsible leg members.

In the present embodiment of the invention, therefore, said bed supporting leg members do not make any difference as long as their shape and construction are concerned, and may be of such a conventional type as shown in FIG. 1 of the accompanying drawings.

incidentally, in case of group examination in schools and offices, desks may be replaceable with said leg members 20. In this connection, for the purpose of exclusive use in dental clinics, said dental examination bed 1 is preferably so constructed that both the forward bed portion 1*a* and the rearward bed portion 1*c* are connected to one another by means of thumb nuts in collapsible relation as shown in FIG. 2, or otherwise formed so that one edge of said bed portion 1*a* is engraved with a groove 21 and one edge of said bed portion 1*c* corresponding to said edge is formed into a feather edge so as to be engaged with one another in a match joint relation.

Further in order to facilitate the movement of the dental examination bed 1, said leg members 20 may be replaced with such conventionally known type leg members 20' as shown in FIG. 3 so as to be collapsed into less bulky size. Futhermore it is also possible to detachably mount said leg members 20' to the bed 1 by screwably forcing the members 20' into the backside of the bed 1.

What is claimed is:

1. A simple dental service equipment comprising:

(a) a dental examination bed including a forward portion and a rearward portion, with both portions being connected in mutually collapsible relationship with each other and defining a substantially flattened upper surface;

(b) the forward edge and rearward edge of the bed being each curved into an arc shape;

(c) a headrest detachably mounted to the forward edge;

(d) a substantially L-shaped supporting means for supporting a light projector;

(e) tightening means rigidly attached to one side of a lower portion of the L-shaped supporting means, to removably attach the supporting means to the forward portion of the dental examination bed;

(f) a light projector carried at an upper end of the L-shaped supporting means disposed generally above the headrest;

(g) an annular shaped tray supporting member having one side attached to the L-shaped supporting means adjacent the lower portion thereof such that the supporting member extends from the L-shaped supporting member in a direction opposite from the tightening means; and (h) tray holding means attached to and disposed above the tray supporting member and extending inwardly toward its center such that the edge of a dental tray may be inserted between the tray supporting member and the tray holding means to hold the tray stationary by its own gravity and extending in a direction away from the examination bed.

2. The dental service equipment of claim 1 wherein the examination bed further includes a plurality of collapsible leg members.

* * * * *